United States Patent [19]

Remmers

[11] Patent Number: 4,781,166

[45] Date of Patent: Nov. 1, 1988

[54] VOLTAGE REGULATED MAGNETO POWERED CAPACITIVE DISCHARGE IGNITION SYSTEM

[75] Inventor: Gregry M. Remmers, Ingleside, Ill.

[73] Assignee: Outboard Marine Corporation, Waukegan, Ill.

[21] Appl. No.: 67,702

[22] Filed: Jun. 29, 1987

[51] Int. Cl.[4] ..... F02P 3/09

[52] U.S. Cl. ..... 123/597; 123/599; 315/218

[58] Field of Search ..... 123/599, 597; 315/218, 315/209 CD

[56] References Cited

U.S. PATENT DOCUMENTS

| | | | |
|---|---|---|---|
| 3,293,523 | 12/1966 | Hutson | 307/324 |
| 3,490,426 | 1/1970 | Farr | 123/599 |
| 3,801,893 | 4/1974 | Joyce | 321/43 |
| 3,933,140 | 1/1976 | Gynn | 123/595 |
| 4,095,163 | 6/1978 | Montague | 323/8 |
| 4,216,756 | 8/1980 | Mura | 123/597 |
| 4,404,940 | 9/1983 | Sieja | 123/599 |
| 4,695,771 | 9/1987 | Hallay | 315/209 CD |

OTHER PUBLICATIONS

Teccor Data Sheet, Teccor Electronics, Inc., Irving, Tex., "SIDAC's 95-341 Volts", pp. 61-66.

*Primary Examiner*—Andrew M. Dolinar
*Attorney, Agent, or Firm*—Welsh & Katz, Ltd.

[57] ABSTRACT

Disclosed herein is a voltage regulated magneto powered capacitive discharge ignition system including a charge capacitor, a magneto including a charge coil, and a circuit including a rectifier having input terminals respectively connected to the charge coil and having output terminals respectively connected to the charge capacitor for insuring unidirectional current flow from the charge coil to the charge capacitor. The system also includes a voltage regulator including a silicon bilateral voltage triggered switch having first and second anodes respectively connected to opposite end terminals of the charge coil. In response to a voltage developed on the charge coil exceeding a predetermined value, the silicon bilateral voltage triggered switch is rendered conductive so that the charge coil is shunted by the silicon bilateral voltage triggered switch so that further charging of the charge capacitor is prevented.

4 Claims, 1 Drawing Sheet

VOLTAGE REGULATED MAGNETO POWERED CAPACITIVE DISCHARGE IGNITION SYSTEM

BACKGROUND OF THE INVENTION

This invention relates generally to magneto powered capacitive discharge ignition systems for internal combustion engines and more particularly to magneto powered capacitive discharge systems including a voltage regulation circuit for regulating the voltage developed on a charge capacitor utilizing a high power silicon bilateral voltage triggered switch.

Typical prior art regulator circuits utilized in magneto powered capacitive discharge ignition systems have employed SCR or transistors tirggered by zener diodes, or employed one or more series connected zener diodes connected directly in parallel with the charge capacitor. Ideally, these regulator circuits prevent overcharging of the charge capacitor by limiting the magnitude of the voltage at the positive terminal of the charge capacitor to the zener diode breakdown voltage. The components of such voltage regulator circuits, however, are subject to high power dissipation and failure due to component tolerance and excessive voltage on the charge capacitor, or due to high magnitude voltage and current surges occurring during discharge of the charge capacitor through the primary winding of the ignition coil.

Another typical prior art voltage regulator circuit uses a zener diode connected in parallel across the magneto charge coil upstream of a blocking diode. The zener diode in this arrangement limits the positive voltage output of the magneto charge coil to the zener diode breakdwon voltage, but shunts the negative output of the charge coil, thereby undesirably reducing the speed at which the charge capacitor charges, and consequently, a magnitude of the voltage developed thereon. Further, the zener diode in such circuits is subject to excessive magneto charge coil voltage, due to component tolerance, or due to an open circuit fault in the ignition triggering SCR or the primary winding ignition coil circuits. As a result of such excessive voltage, the zener diode is subject to excessive power dissipation and consequent failure.

Another type of ignition system voltage regulator circuit known in the art utilizes a triac and varistor circuit connected in parallel with the charge capacitor to prevent overcharging of the charge capacitor. In this type of circuit, the varistor is connected to one end terminal of the charge coil and the other terminal is connected to the gate of the triac. The varistor is rendered conductive and applies a trigger current pulse to the triac gate rendering the triac conductive in response to a voltage on the charge capacitor exceeding a predetermined value. This triacvaristor circuit configuration is subject to component failure of both the triac and the varistor, requires multiple components to perform the switching function, and fails to provide a high degree of accuracy of regulation.

Thus, all of these prior art voltage regulator circuits utilized in magneto powered capacitive discharge ignition systems have been subject to voltage regulator component failures and hence have proven insufficiently reliable. Particularly, the semiconductor devices in such circuits are subjected to high voltages and currents which result in failure due to the power dissipated in the device or due to high voltage breakdown. In addition, these components have not provided consistent, accurate regulation thereby subjecting other circuit components to excessive voltages leading to increased failure rates. The failure of such prior art voltage regulator circuits has been particularly serious and troublesome because it results in the failure of the ignition system, and more importantly, because it results in the failure of the internal combustion engine and the vehicle in which the ignition system controls. Such voltage regulator failure requires an annoying and costly replacement or repair of the voltage regulator circuit before the ignition system and hence, the internal combustion engine and vehicle, can again be made operative.

BRIEF SUMMARY OF THE INVENTION

It is accordingly an object of this invention to provide a novel voltage regulation magneto powered capacitive discharge ignition system with increased reliability.

It is another object of the invention to provide a novel voltage regulated magneto powered capacitive discharge ignition system with improved voltage regulation capability with high accuracy of regulation.

It is yet another object of the present invention to provide a novel voltage regulated magneto powered capacitive discharge ignition system which is economical to manufactures with minimum part count.

Briefly, according to one embodiment of the invention, a voltage regulated magneto powered capacitive discharge ignition system is provided including a charge capacitor having opposite plates, a magneto including a charge coil having opposite end terminals and circuit means for a respectively connected the opposite plates of the charge capacitor to the end terminal of the charge coil and including rectifier means for insuring unidirectional current flow from the charge coil to the charge capacitor. The ignition system also includes voltage regulator means including two terminal, bidirectional semiconductor voltage triggered switching means having first and second terminals, the first and second terminals being respectively connected to the end terminals of the charge coil, the switching means being rendered conductive between the first and second terminals in response to a voltage developed in a charge capacitor exceeding a predetermined value thereby shunting the charge coil further preventing charging of the charge capacitor.

In accordance with a specific embodiment of the invention, the two terminal bidirectional switching means comprises a Sidac including first and second anodes which respectively comprise the first and second terminals of the switching means. The Sidac provides increased accuracy of regulation due to its sharp switching characteristics and its silicon construction. The Sidac is also highly reliable due to the low power dissipation that results from its negative resistance region and due to a rapid drop in magneto current when it is short circuited.

Also in accordance with another specific embodiment of the invention, the rectifier means comprises a full wave bridge having input terminals respectively connected to the end terminals of the charge coil and output terminals respectively connected to the plates of the charge capacitor. The first and second terminals of the two terminal switching means are respectively connected to the bridge input terminals so that the switching means is isolated from the current surges which result during discharge of the charge capacitor.

BRIEF DESCRIPTION OF THE DRAWINGS

The invention, together with further objects and advantages thereof, may be understood by reference of the following description taken in conjunction with the accompanying drawings.

DETAILED DESCRIPTION OF THE PREFERRED EMBODIMENT

Figure 1:
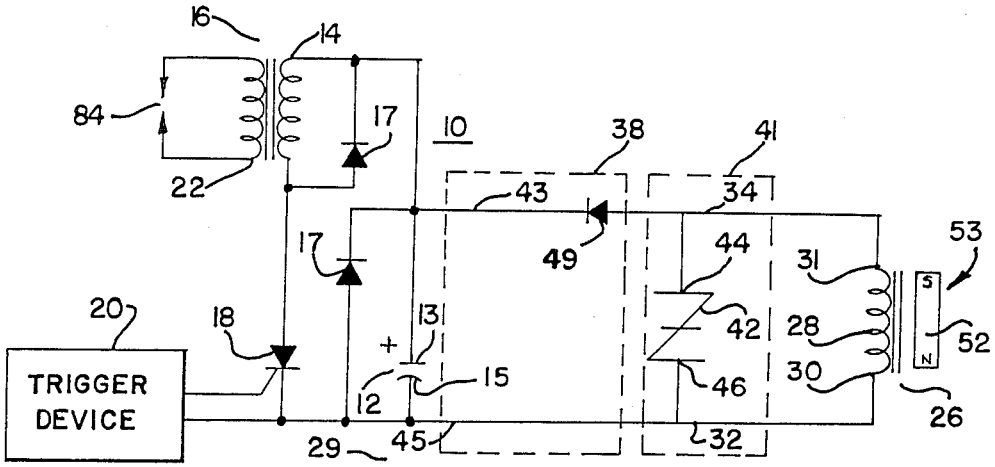
FIG. 1 is a schematic diagram of a specific embodiment of a voltage regulated magneto powered capacitive discharge ignition system embodying various features of the present invention.

Referring now to FIG. 1, there is illustrated a specific embodiment of a voltage regulated magneto powered capacitive discharge ignition system 10 utilizing a bilateral voltage triggered switch 42. The system 10 includes a charge capacitor 12 connected in circuit with a primary winding 14 of an ignition coil 16 and an SCR 18 coupled to a suitable triggering device 20 which periodically renders the SCR conductive so that the charge capacitor 12 discharges through the primary winding 14, inducing a voltage in the secondary winding 22 to fire a spark plug 24. Protection diodes 17 are conventionally coupled across the charge capacitor 12 and the primary winding 14 to shunt negative voltage surges due to the inductive nature of the loads. In order to deliver a charging current to the charge capacitor 12, the system 10 includes a magneto 26 having a charge coil 28 with end terminals 30 and 31.

More particularly, the system 10 also includes circuit means generally designated 29 including conductors 32 and 34 for respectively connecting the opposite plates 13 and 15 of the charge capacitor 12 to the end terminals 30 and 31 of the charge coil 28 via conductors 45 and 43 respectively. The circuit means also include rectifier means, generally rectifier means 38, for insuring unidirectional current flow from the charge coil 28 to the charge capacitor 12 so that a Voltage is impressed across the capacitor such that plate 13 is positive and plate 15 is negative. The voltage of the charge capacitor follows and is substantially the same as the voltage developed across the charge coil as a result of the charging current. As illustrated, the rectifier means 38 may comprise a semiconductor diode 9 having its anode coupled to the conductor 34 and its cathode connected to the plate 13 of the capacitor 15 via the conductor 43.

The ignition system 10 also includes voltage regulator means, generally designated 41, which is connected in the circuit between the magneto charge coil 28 and the rectifier means 38. More particularly, the voltage regulator means 41 includes a two terminal semiconductor bidirectional voltage triggered switching means 42, having first and second terminals, 44 and 46 respectively connected to the end terminals 30 and 31 of the charge coil 28 by leads 32 and 34. The switching means 42 in the illustrated embodiment is a silicon bilateral voltage triggered switch or Sidac (e.g., a model K3000F1 marketed by Teccor Electronics, Inc.). The switching means 42 is rendered conductive between the first and second terminals 44 and 46 in response to the charge voltage developed on the charge capacitor 12 exceeding a predetermined voltage equal to the breakover voltage of the Sidac 42. This short circuits or shunts charge coil 28, preventing further charging of the charge capacitor 12. Thus, the voltage regulator means 41 limits the charging of the charge capacitor 12 after the voltage on the charge capacitor 12 exceeds the predetermined value or breakover voltage of the Sidac 42, and thereby effects the desired voltage regulation. In the illustrated embodiment, the breakover voltage is approximately 300 volts.

Typically, such bilateral semiconductor switches are not suitable for use in such circuits due to the high voltage (e.g., approximately 300 volts) and substantial current generated by the magneto which can cause high power dissipation and can result in high rate of component failure. However, the Sidac has a negative resistance region immediately following breakover (i.e., switching to a conductive state) and the magneto current drops rapidly when the coil is short circuited resulting in very low power dissipation in the device and thus high reliability. In addition, the abrupt switching characteristic and reproducability of the breakover voltage (i.e., switching voltage) of the Sidac results in greater accuracy of regulation than is achievable by prior art systems. This increases reliability and reduces costs by preventing other circuit components from being subjected to a wide range of high voltage. Cost is further reduced by the fact that only a single component is needed to provide the necessary regulation.

In the system 10 illustrated in FIG. 1, the rectifier means 38 includes a single blocking diode or half wave rectifier 49 which only allows positive voltages and currents flowing from the magneto charge coil 28 to reach the charge capacitor 12. Thus, in the event of failure of the diodes 17, negative voltage surges appearing on line 43, such as results from the discharge of the charge capacitor 12, are conveyed through the diode to the voltage regulator means 41 by the conductor 34. Such voltage surges, however will not cause failure of the voltage regulator means 41, because the voltage impressed across the regulator means is limited to the breakover value of the Sidac 42.

Figure 2:
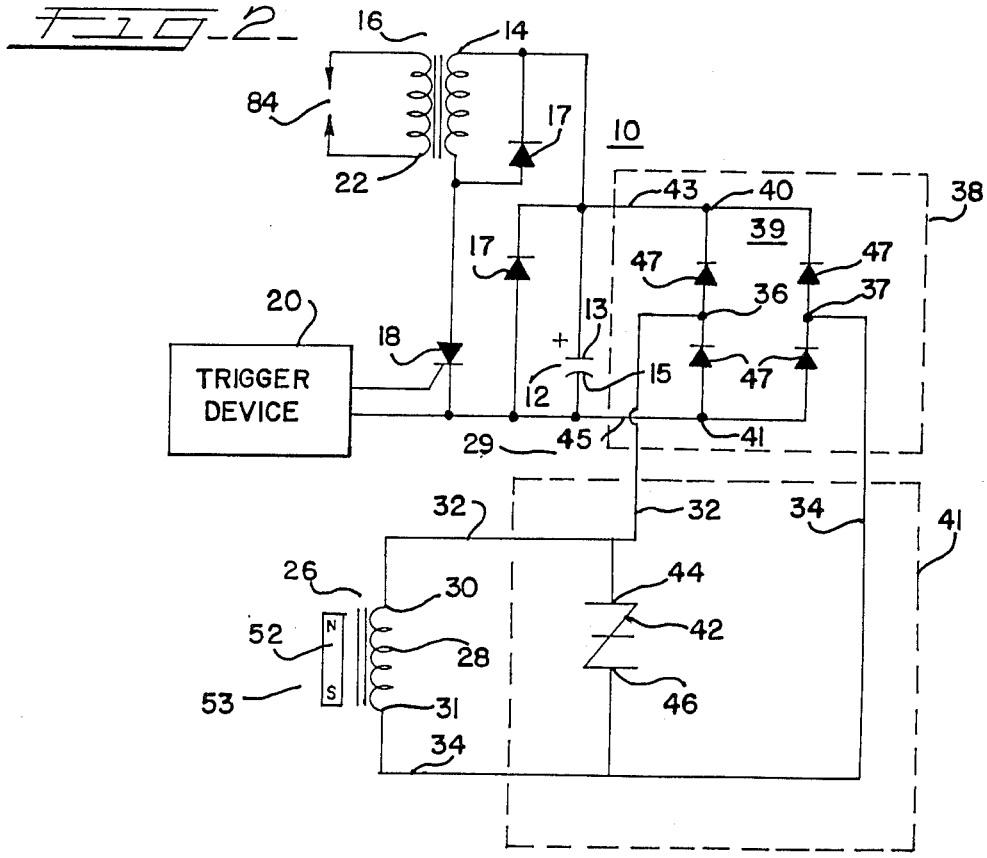
FIG. 2 is a schematic diagram illustrating another specific embodiment of a voltage regulated magneto powered capacitive discharge ignition system embodying the various features of the invention.

In an alternative embodiment illustrated in FIG. 2, the rectifier means 38 comprises a full wave bridge 39 having four conventionally connected diodes 47. The full wave bridge 39 includes a pair of input terminals 36 and 37 respectively connected to the charging coil end terminals 30 and 31 through the conductors 32 and 34. In addition, a pair of output terminals 40 and 41 respectively are connected to the capacitor plates 13 and 15 by means of the conductors 43 and 45. In this embodiment, the voltage regulator means 41 is isolated and protected from discharge surge currents which may result during discharge of the charge capacitor 12. More particularly, since the first and second terminals 44 and 46 of the switching means 42 are respectively connected to the full wave bridge input terminals 36 and 37, no potential difference or voltage can be fed back to the input terminals 36 and 37 to the first and second terminals 44 and 46. This is because the bridge diodes 47 provide for unidirectional current flow and block any positive voltage being transmitted back to the voltage regulator means 41. The negative voltages which may appear along the conductor 43 pass through both of the diodes 47 having their cathodes connected to the conductor 43, and hence both bridge input terminals 46 and 47 are at the same potential so that no potential difference is impressed across the conductors 32 and 34, and hence across the voltage regulator means 41 connected thereto.

For the purposes of a more detailed description of the operation of the invention, reference will primarily be made to FIG. 1. More particularly, as illustrated in FIG. 1, the two terminal bidirectional voltage trigger switching means of the illustrated embodiment comprises a Sidac 42. The Sidac includes first and second anodes 44 and 46 and is rendered conductive between the first and second anodes in the illustrated embodiment by a voltage of approximately 300 volts across the first and second anodes 44 and 46. This feature results in the Sidac 42 shunting the charge coil 28 for both polarities, thereby effectively limiting the charging of the charge capacitor 12. Because the Sidac 42 has a negative resistance region immediately following breakover and because the magneto current drops rapidly when short circuited, there is very low potential for damaging the Sidac 42 due to power dissipation. The breakover voltage and bidirectional switching characteristics of the Sidac 42 are important features since the bidirectional breakdown value sets the maximum voltage, for either polarity, at which the Sidac 42 is gated, and hence, sets the voltage level at which the charge capacitor is regulated. In addition, since it is bidirectional, a Sidac 42 also sets the maximum voltage seen by any components in either polarity thereby protecting all the components of the circuit.

During operation of the ignition system 10, an alternating voltage is developed across the terminals 30 and 31 of the magneto charge coil 28 in response to rotation of the magnets 52 of the magneto 53. This voltage is rectified by the rectifier circuit 38 and the charging current if fed to the charge capacitor 12 so that the capacitor plate 13 has a positive polarity, as shown. Since the charge capacitor 12 provides the load for the magneto charge coil, the magnitude of the voltage across the charge capacitor follows and is substantially the same as the magnitude of the voltage developed across the charge coil. The maximum magnitude of the voltage developed on the charge capacitor 12 is, for example, within a range of 280 to 340 volts in the illustrated embodiment. The ignition SCR 18 is triggered into conduction by a conventional triggering device 20, such as a trigger coil (not specifically shown). When the ignition SCR 18 is triggered, current flows from plate 13 on the charge capacitor 12 through the ignition coil primary winding 14, through the SCR 18 and back to the plate 15 of the capacitor, as a result of which the secondary winding 22 of the ignition coil 16 steps up the voltage to fire the spark plug 24.

The voltage regulator means 41 operates to limit the charging current and voltage developed on the charge capacitor 12 as follows. As the engine speed increases, the magnitude of the charging voltage on the charge capacitor increases, and may exceed device ratings due to component tolerances and the nature of the magneto. The Sidac 42 conducts when the voltage of the charge capacitor 12 increases above a predetermined value, i.e., above the breakover voltage of the Sidac 42. The Sidac 42 conducts between its anodes 44 and 46, thus shunting the charge coil 28 and preventing any further charging current from reaching the charge capacitor 12. Because of the Sidac component tolerances, the predetermined value of the voltage on the capacitor varies within a narrow range (e.g., a range of 280 to 340 volts in the illustrated embodiment). Such a variance is narrower than that achievable in the prior art, thereby providing more accurate control and regulation than prior art circuits using triacs or zeners, and providing improved performance and reliability of the ignition system 10.

When the Sidac 42 is triggered, it switches to a low "on state" resistance. Thus, the voltage across the charge coil rapidly approaches zero. In addition, in the initial period after breakover, the Sidac has a negative resistance region. Consequently, there is relatively little power dissipation in the Sidac 42 resulting in long life and highly reliable operation. The Sidac turns off when the charge coil voltage passes through zero, but the Sidac is again triggered into conduction when the magntitude of the opposite polarity of the voltage developed across the charge coil again reaches the predetermined breakover value of the Sidac 42. Thus, whenever the magnitude of the voltage of the charge coil 28, which is normally substantially the same as that developed on the charge capacitor, exceeds the predetermined value or breakover voltage of the Sidac 42, the Sidac 42 triggers into conduction and, in turn, shunts the charge coil 28 to prevent overcharging of the capacitor.

If, for any reason, the charge capacitor 12 is not charging and discharging in the normal manner, for example, as a result of open circuit faults in the ignition triggering SCR 18 or primary winding ignition coil circuits, the charge capacitor voltage will be maintained and over-charging will be preventing by the voltage regulator means since the voltage developed by the magneto charge coil 28 is limited to the predetermined breakover voltage of the Sidac 42. For the same reason, any negative voltage surges which may be conveyed back through the rectifier means 38 to the voltage regulator means 41 will be limited so that it will not damage the components of the voltage regulator means 41. This is because the voltage across the Sidac 42, which acts as a shunt, rapidly approaches zero after being triggered, thereby preventing overcharging of the charge capacitor. Consequently, there is relatively little power dissipation in the voltage regulator and no damage of these or other components of the ignition system.

Specific embodiments of the voltage regulated magneto powered capacitive discharge ignition system has been described for the purpose of illustrating the manner in which the invention may be made and used. It should be understood that implementation of other variations and modifications of the invention in its various aspects will be apparent to those skilled in the art, and that the invention is not limited by the specific embodiments described. It is therefore contemplated to cover by the present invention any and all modifications, variations, or equivalents that fall within the spirit and scope of the basic underlying principles disclosed and claimed herein.

What is claimed is:

1. A voltage regulated magneto powered capacitive discharge ignition system comprising a charge capacitor having opposite plates, a magneto including a charge coil having opposite end terminals, circuit means for respectively connecting said opposite plates of said charge capacitor to said end terminals of said charge coil and including rectifier means for insuring unidirectional current flow from said charge coil to said charge capacitor, said rectifier means having input terminals respectively connected to said end terminals of said charge coil and output terminals respectively connected to said plates of said charge capacitor, and voltage regulator means for operationally clamping the voltage of the charge coil including two terminal, bidirectional semiconductor voltage triggered switching means comprising a Sidac having first and second anode terminals, said first and second terminals being respectively connected to said end terminals of said charge coil and to said input terminals of said rectifier, said switching means being self triggered and thereby rendered conductive between said first and second terminals in response to a voltage developed on said charge coil exceeding a predetermined value thereby shunting said charge coil so that further charging of said charge capacitor is prevented.

2. A voltage regulated magneto powered capacitive discharge ignition system according to claim 1 wherein said rectifier means is a full wave rectifier.

3. The voltage regulated magneto powered capacitive discharge ignition system according to claim 1 wherein said switching means is a high voltage device having a negative resistance region after switching to a conductive condition.

4. A voltage regulated magneto powered capacitive discharge ignition system comprising:

a charge capacitor having opposite plates;

magneto including a charge coil having opposite end terminals;

circuit means including a rectifier having input terminals respectively connected to said end terminals of said charge coil, and having output terminals respectively connected to said plates of said charge capacitor for insuring unidirectional current flow from said charge coil to said charge capacitor, and voltage regulation means for operationally clamping the voltage of the charge coil including a Sidac, and having first and second terminals respectively connected to said end terminals of said charge coil and to said input terminals of said rectifier, said connection of said Sidac to said rectifier input terminals resulting in said Sidac being isolated from current surges which result during discharge of said charge capacitor, said Sidac being rendered conductive in response to voltage developed on said charge coil exceeding a predetermined value, thereby shunting said charge coil and preventing further charging of said charge capacitor.

* * * * *